US006533376B1

(12) United States Patent
Gailus et al.

(10) Patent No.: US 6,533,376 B1
(45) Date of Patent: Mar. 18, 2003

(54) CONDITIONING INK JET ORIFICES

(75) Inventors: David W. Gailus, Portland, ME (US); Edward R. Moynihan, Plainfield, NH (US); Jill Ann Hanson, Charlestown, NH (US); Michael Joseph Garcia, South Reading, VT (US); David A. Swett, North Sutton, NH (US)

(73) Assignee: Spectra, Inc., Lebanon, NH (US)

( * ) Notice: Subject to any disclaimer, the term of this patent is extended or adjusted under 35 U.S.C. 154(b) by 0 days.

(21) Appl. No.: 09/239,895

(22) Filed: Jan. 29, 1999

(51) Int. Cl.[7] ..... B41J 2/165
(52) U.S. Cl. ..... 347/1; 347/22
(58) Field of Search ..... 347/1, 22, 26; 29/890.1; 134/1

(56) References Cited

U.S. PATENT DOCUMENTS

| | | | | | |
|---|---|---|---|---|---|
| 4,675,498 | A | * | 6/1987 | Lemelson | 347/248 |
| 4,947,184 | A | | 8/1990 | Moynihan | 346/1.1 |
| 5,194,877 | A | | 3/1993 | Lam et al. | 346/1.1 |
| 5,227,098 | A | * | 7/1993 | Philby et al. | 264/400 |
| 5,353,052 | A | * | 10/1994 | Suzuki et al. | 347/19 |
| 5,361,087 | A | | 11/1994 | Tajima et al. | 347/44 |
| 5,365,255 | A | | 11/1994 | Inoue et al. | 347/45 |
| 5,548,894 | A | | 8/1996 | Muto | 29/890.1 |
| 5,640,184 | A | | 6/1997 | Moynihan et al. | 347/47 |
| 5,714,078 | A | | 2/1998 | Thiel | 216/77 |
| 5,771,052 | A | | 6/1998 | Hine et al. | 347/42 |
| 5,790,147 | A | | 8/1998 | Hensel | 347/28 |
| 5,796,415 | A | * | 8/1998 | Inoue et al. | 347/45 |
| 6,056,827 | A | * | 5/2000 | Fukui et al. | 134/1 |

FOREIGN PATENT DOCUMENTS

| | | | | |
|---|---|---|---|---|
| JP | 64-71759 | * | 3/1989 | 347/26 |

* cited by examiner

*Primary Examiner*—Anh T. N. Vo
(74) *Attorney, Agent, or Firm*—Fish & Richardson P.C.

(57) ABSTRACT

Conditioning an ink jet orifice by illuminating the orifice with radiation from a laser to remove contaminants and smooth rough surfaces.

38 Claims, 8 Drawing Sheets

CONDITIONING INK JET ORIFICES

FIELD OF THE INVENTION

This invention relates to conditioning ink jet orifices.

BACKGROUND OF THE INVENTION

In ink jet printing, ink is ejected from a narrow orifice in the direction of a substrate. In one type of ink jet printing, known as drop on demand printing, the ink is ejected in a series of droplets. The droplets may be produced and controlled using a piezoelectric ink jet head which has a large number of orifices, each of which is separately controllable to selectively eject ink at desired locations, or pixels, of the image. For example, an ink jet head may have 256 orifices that have a spacing for a printing resolution of 100 pixels (dots) per inch (dpi) or more. This dense array of orifices allows complex, highly accurate images to be produced.

The quality of the images suffers, however, if one or more of the orifices becomes obstructed. For example, a partially obstructed orifice may alter the direction, size, or stability of the droplets. A fully obstructed orifice reduces print quality by causing gaps in the image.

SUMMARY OF THE INVENTION

In an aspect, the invention features conditioning an ink jet orifice by illuminating the orifice with radiation. In another aspect, the invention features conditioning an ink jet orifice using a printing station arranged to permit the print head to print an image on a substrate, and a radiation source arranged to illuminate the orifice. In another aspect, the invention features conditioning an ink jet orifice using a testing station arranged to test the operation of the orifice, and a radiation source arranged to illuminate the orifice.

Embodiments may include one or more of the following. The radiation is selected to remove organic contaminant material. The organic material is selected from the group consisting of ink, polymer, and protein. The radiation is selected.to smooth regions of the ink jet head proximate the orifice. The radiation is UV radiation. The radiation is provided by an excimer laser. The excimer laser has a wavelength of about 248 nm and a fluence of about 0.3 to about 1.5 Joule/cm$^2$, e.g., about 0.5 Joule/cm$^2$.

Embodiments may also include one or more of the following. The radiation,is focused to a focal point. The radiation is selected to remove contamination to a depth inside the orifice no greater than about 15 $\mu$m. The focal point is inside the orifice. The radiation has a beam diameter smaller than the width of the orifice. The radiation impinges the orifice at an angle with respect to the axis of the orifice. A coolant is used in proximity with the orifice. The coolant is gas. An ozone-forming gas and radiation at a select wave length are used to form ozone.

Embodiments may also include one or more of the following. The orifice is in a plate fabricated from metal, polymer, or ceramic. The orifice has a diameter of about 70 $\mu$m or less, e.g., about 15 to about 50 $\mu$m. The plate has a plurality of orifices separated by about 0.015 inch or less, e.g., about 0.004 to about 0.012 inch. The ink jet orifice is an ink jet orifice for a piezoelectric drop on demand ink jet head.

Embodiments may include one or more of the following. The operation of the orifice is tested by jetting a test image. The image is visually inspected or electronically inspected. A transport arrangement transports the orifice between a printing station to an illuminating station including the source of radiation and a testing station. The transport arrangement includes a rail system.

Embodiments may include one or more of the following advantages. For example, print head orifices can be quickly, efficiently, and inexpensively cleared of obstructions, such as those arising during manufacture or use. The conditioning can greatly improve the manufacturing yield of print heads. For example, print heads rejected for droplet instability or orifice obstructions may be recovered by radiation conditioning. Heads that develop obstructions in use, e.g., dried ink obstructions, can be quickly and easily conditioned without the need to replace the head or orifice plate. Print heads can also be conditioned even if they do not have an obstruction, to smooth rough surfaces and sharp corners adjacent to the orifice, which can improve droplet formation and jetting characteristics. Print heads can also be radiation conditioned to remove conformal coatings.

Further advantages, aspects, and features, follow.

DESCRIPTION OF THE PREFERRED EMBODIMENTS

Figure 1:
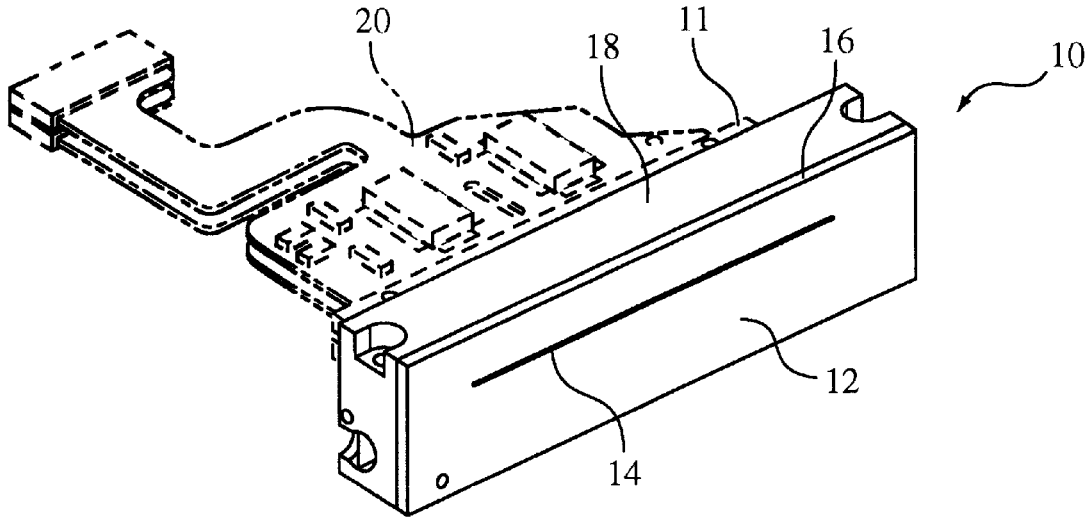
FIG. 1 is a front perspective view of an ink jet print head and FIG. 1*a* is a back perspective view of an ink jet print head.
Figure 1A:
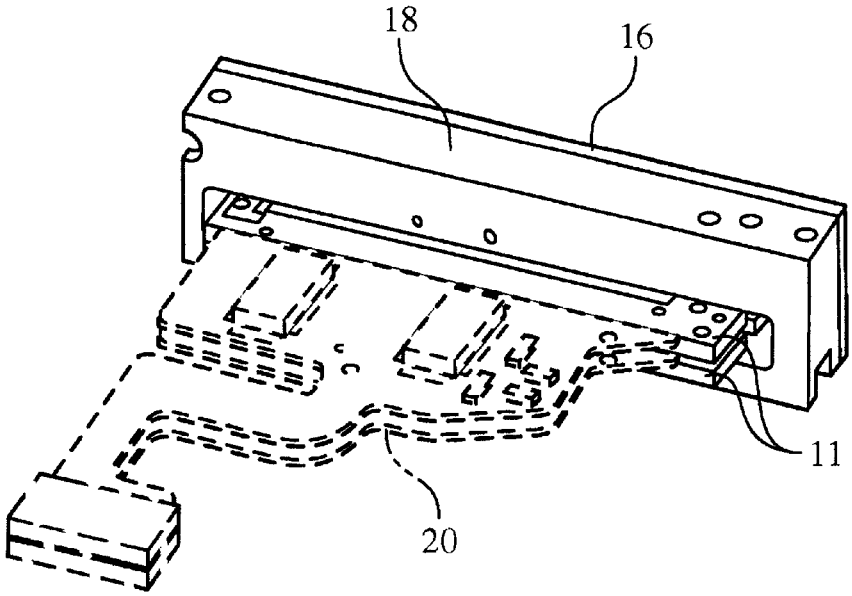
Figure 2:
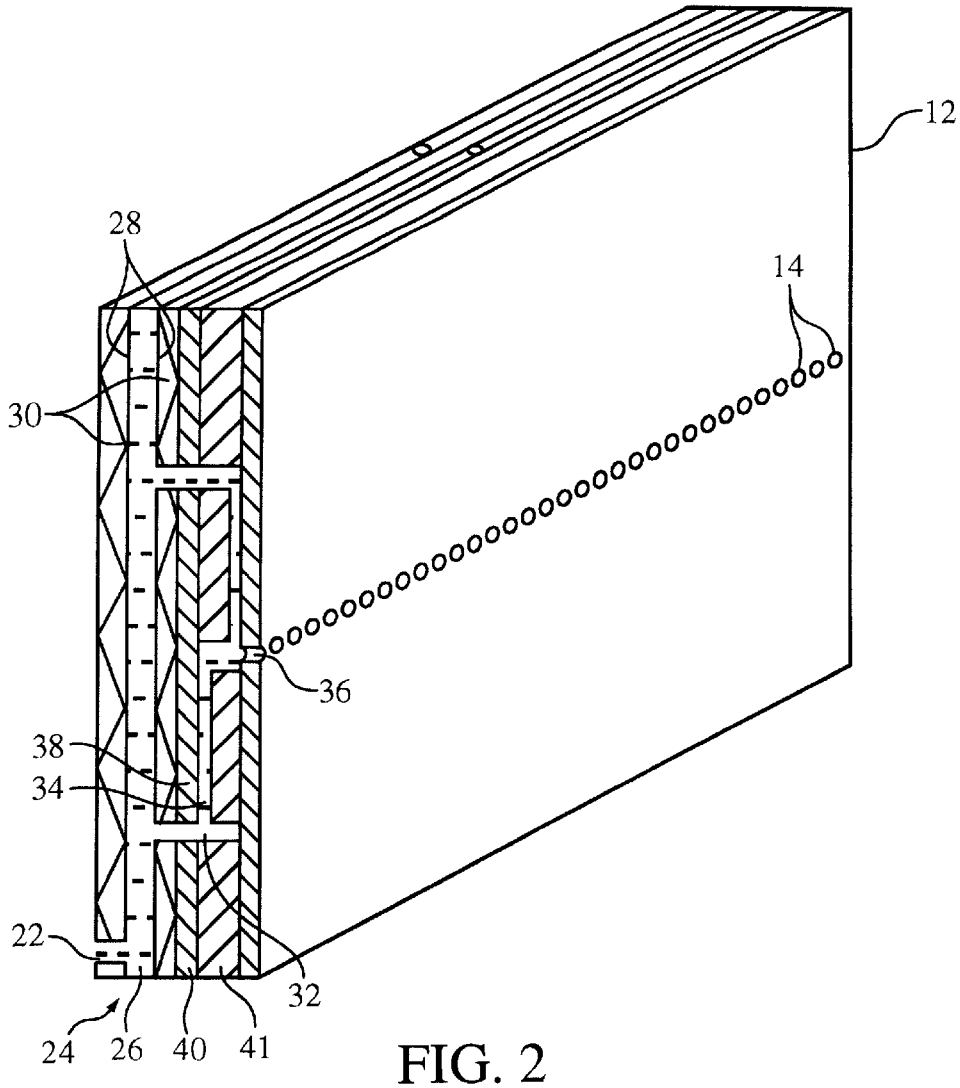
FIG. 2 is a perspective sectional view of an ink jet print head.

Referring to FIGS. 1–2, a piezoelectric ink jet print head 10 includes jetting modules 11 and an orifice plate 12 with an array 13 of orifice openings 14. The orifice plate 12 is mounted on a manifold 16, attached to a collar 18. The ink jet print head 10 is controlled by electrical signals conveyed by flexprints 20.

Referring particularly to FIG. 2, in operation, ink flows from a reservoir (not shown) into a passage 22, which leads to deaerator 24. Deaerated ink is conveyed through a passage 32 to a pressure chamber 34 from which it is ejected on demand through an orifice passageway 36 and a corresponding orifice opening 14 in the orifice plate 12 in response to selective actuation of the adjacent portion 38 of a piezoelectric plate 40. Passages 32, 34, and 36 are formed in a plate 41 made of carbon. Carbon plate 41 is bonded to orifice plate 12 on one side, and piezoelectric plate 40 on the other side. The orifice plate is made out of metal (e.g., stainless steel, nickel, gold), ceramic (e.g., glass, alumina, zirconia), or polymer (e.g., polyimide (Kapton), PEEK). Ink jet print heads of this type are described in more detail in Moynihan et al., U.S. Pat. No. 5,640,184 and Hine et al., U.S. Pat. No. 5,771,052, which describes a modular arrangement. The entire contents of these patents are incorporated herein by reference. An example is the 256 jet, 600 dpi, CCP-256 print head available from Spectra, Inc., Hanover, N. H.

Figure 3:
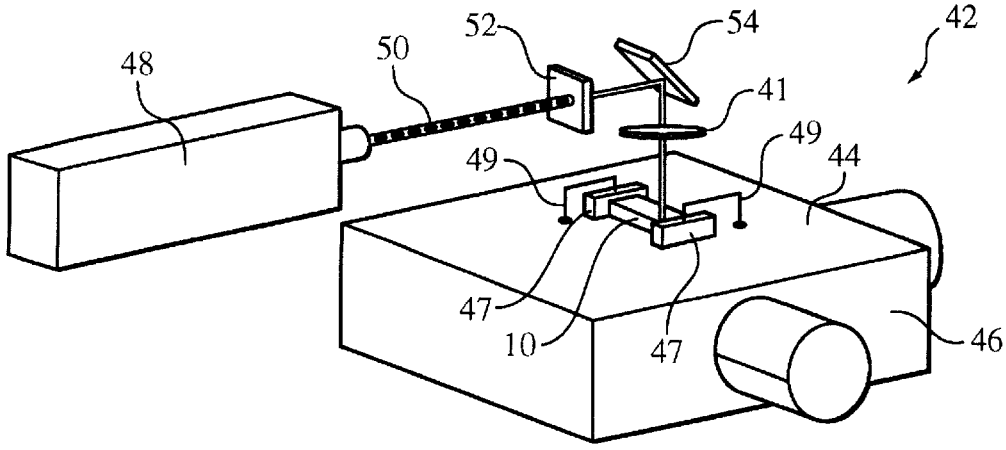
FIG. 3 is a perspective view of a system for conditioning ink jet orifices.

Referring to FIG. 3, the ink jet print head 10 is conditioned at a conditioning station 42. An assembled ink jet print head, or the orifice plate/carbon plate portion, or just the orifice plate, is placed, orifice plate facing upward, on a stage 44 of an x-y table 46. The stage includes blocks 47, held by clamps 49, arranged to maintain the print head in a stable condition without contacting the face of the orifice plate. A laser 48 generates a beam 50. The beam 50 passes through a mask 52 to produce a beam 40 of desired size and shape and a mirror 54 deflects the beam 40 which passes through a focusing lens 41 and impinges on the ink jet print head 10. The beam 40 conditions the print head by removing contamination on the surface of the orifice plate, in the orifice opening 14, in the orifice passageway 36 and/or below the orifice. The beam may also be of a sufficient intensity to condition the orifice plate by smoothing surfaces proximate the orifice.

Figure 4A:
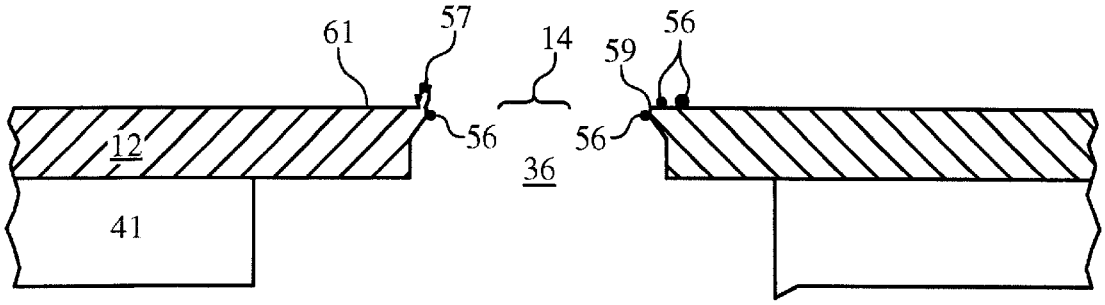
FIG. 4A is a cross section of an orifice prior to conditioning.

Referring to FIG. 4A, prior to conditioning, contamination 56 may adhere to the edges of orifice opening 14 and may also be disposed inside the orifice passageway. Contamination is typically organic in nature. It may be composed of residual ink, e.g., wax based hot melt inks or ink varnish. It may also be epoxy used in manufacturing the ink jet print head. Under manufacturing conditions, atomized epoxy may settle on or around the orifice. Contamination may also be proteinaceous, such as skin cells sloughed from workers at a manufacturing site. Contamination may also include a conformal coating. Contamination may also include natural or synthetic clothing fibers. The hot surfaces of the print head can cause contaminants to melt and oxidize. This oxidation process may result in the thermal attachment of the contaminant to print head orifices, yielding poor jetting performance.

The surface of orifice plate 12 may also have a somewhat rough morphology as a result of machining operations and orifice forming operations or as a result of rough handling. The roughness is exaggerated in FIGS. 4A and 4B, for illustrative purposes. The roughness may include a burr 57 which may protrude about 5 microns or more. This roughness can adversely affect the transport of ink through the orifice or droplet formation at the opening of the orifice. The periphery of the orifice may also define a sharp edge 59 which can adversely affect droplet formation. Conventional machining or rough handling of the metal plate can also leave gouges and scratches 61 on the surface of the orifice plate adjacent the orifice opening or inside the orifice.

Orifices are typically formed by either electrical discharge machining (EDM) or electroplating. In EDM, an orifice plate, e.g., made of metal, is exposed to an electrical discharge to form the orifices. This process sometimes leaves burrs, which are metal flakes that were not completely removed. The burrs typically form at the periphery of the orifice opening, standing generally parallel to the orifice axis and extending above the orifice opening. In electroplating, a substrate, such as chrome-spattered glass, on which spots of photoresist have been imaged, is plated with a metal, such as nickel. The thickness of the plated metal determines the final orifice diameter. This process can lead to sharp edges around the peripheny of the orifice opening and a rounded countersink known as a "bellmouth" at the bottom of the orifice plate.

Figure 4B:
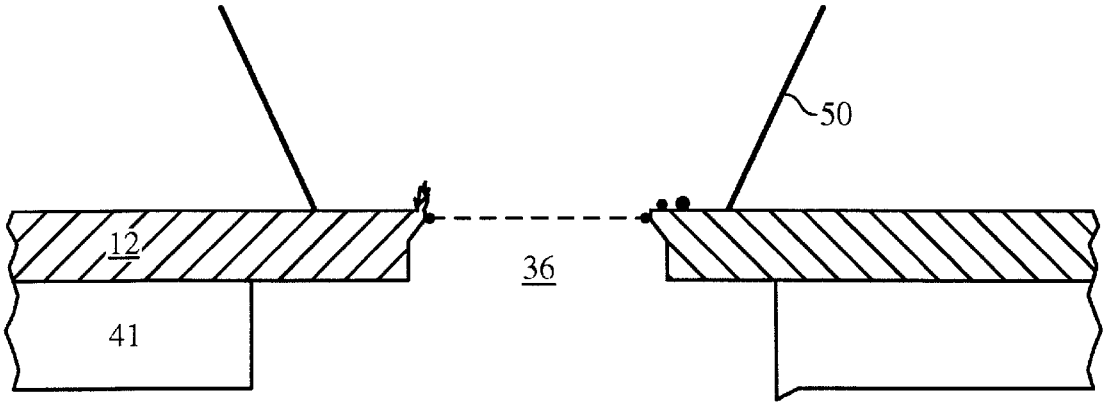
FIG. 4B is a cross section of the orifice in FIG. 4A, during irradiation.

Refer to FIG. 4B, to remove the contamination 56 and/or to smooth the surface of the orifice plate 12, laser beam 50 is directed at the orifice. The energy and wavelength of the laser beam 50 is selected to condition the orifice without damaging the orifice plate or the support plate.

Figure 4C:
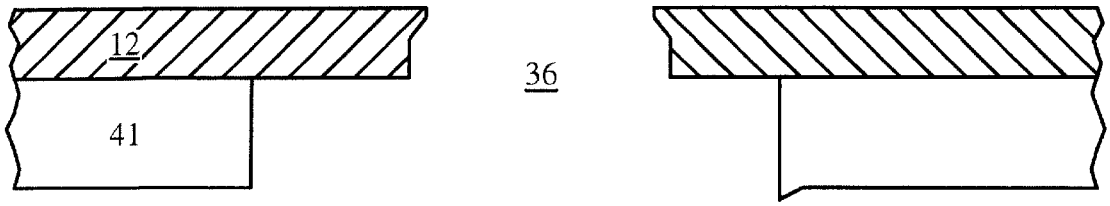
FIG. 4C is a cross section of the orifice in FIG. 4A, after conditioning.

Referring to FIG. 4C, after being exposed to the laser beam 50, the orifice plate 12 is substantially free of contamination. Also, if a beam of sufficient intensity is used, the corners of the orifice plate 12 at the edge of orifice opening 14 are rounded and the surface 58 of the orifice plate 12 is smooth in proximity to the orifice 14. The rounded corners improve the circular symmetry of the nozzle ink meniscus at the nozzle orifice which improves the efficiency of ink ejection. Preferably, the conditioning removes or reduces burrs that protrude by an amount that is about 10% or more of the orifice diameter. Preferably, the conditioned orifice is free of burrs that protrude more than about 3 microns. More preferably, the conditioned orifice is free of burrs greater than about 2 microns.

The mechanism of contaminant removal is believed to be ablation caused by absorption of energy at the laser wavelength by the contaminant material, which leads to rapid heating followed by vaporization. The fluence of the beam and the time of exposure may be selected depending on what material is to be ablated. Exposure to the beam is also believed to locally heat the surface of the orifice plate sufficiently to create surface melting which smooths rough morphology and rounds the edges of the periphery of the orifice. A lower fluence or exposure time may be used for conditioning polymer orifice plates and a greater fluence or exposure time can be used on metal orifice plates.

The energy level on the orifice plate surface and at a given depth inside the passageway can further be controlled by focusing the beam to a focal point, and locating the focal point at a given depth with respect to the passageway. Beyond the focal point, the energy level falls off rapidly. It is typically desirable that the highest energy levels are within the first 100 micron of passageway depth, where most contaminants are typically found, and that the energy is substantially dissipated at the depth of the carbon plate to avoid damaging this component. The location of the focal point may also be scanned along the orifice axis to clean throughout a long passage, e.g. by varying the location of the lens 41 with respect to the orifice plate using a stepping motor (not shown).

In a particular embodiment, a MicroMaster, laser treatment station, which is manufactured by OPTEC and distributed by Reonetics, Nashua, N. H., is used with mounting fixtures such as clamps and blocks. The laser is an ATLEX SP excimer laser, generating a laser beam with a wavelength of 248 nm or 193 nm. The maximum pulse energy is 10 mJ at 248 nm or 5 mJ at 193 nm. It has a maximum repetition rate of 200 pulses/sec and a pulse width of 3–4 ns. The x-y table 46 is motorized with stepper motors with a stepping resolution of 1 $\mu$m; the stage 44 is 25 mm×25 mm. A sample placed on the x-y table 46 can be viewed with a camera (not shown). The camera viewing system includes a TTL-1 on-axis camera display system, a VUV-1 off-axis camera display system, and a monochrome, 2-channel, 9 inch CCTV monitor. The MicroMaster system is controlled with a Pentium computer; the computer's software package includes OPTEC Process Power system control software with CAD/CAM interface. The MicroMaster system also includes a hand-held remote laser controller. The x-y table 46 allows the accurate location of an individual orifice 14. The video microscope system enables the user to see where the laser beam 50 impinges, as well as to observe the ablation of contamination 56. Energy density is measured by a pyrolytic energy meter at the workpiece surface (Molectrom, Inc., Portland, Oreg.).

In a particular embodiment, the carbon plate 41 is 0.13 inch thick and the orifice plate 12 is 0.003 inch thick. The orifice opening diameter is about 0.002 inch (about 52 $\mu$m) and adjacent orifices are separated by about 0.010 inch (center to center). The orifice has a geometry (see FIG. 4A) that includes a region adjacent the opening with substantially vertical walls that extend about 10 $\mu$m deep into the orifice plate, which is followed by a countersink region including a conical section that expands at about 20° to a diameter of about 75 $\mu$m. The conical section is followed by a section of substantially vertical walls for the remaining thickness of the orifice plate. For conditioning a solid nickel orifice plate, the beam 40 is masked so that the size of the beam 50 impinging on the print head 10 is 0.020 inch width×0.030 inch length. The laser is operated at a pulse rate of 150 pulses/sec at a wavelength of 248 nm and fluence of about 0.5 Joule/cm$^2$. The print head is stepped under the beam after 50 pulses of irradiation, at a step width of about 0.023 inch, which is about 75% of the beam width. Since the spacing of the orifices is less than the beam width, two orifices are illuminated simultaneously, and each orifice is exposed to about 100 pulses. Typically, for conditioning within the passageway, the focal point of the beam is at or slightly below the surface 58 of the orifice plate 12. The focal point of the laser beam has a focal depth of maximum energy of about 15–25 $\mu$m. Focusing the beam at the orifice surface typically removes contamination to a depth of 7–10 $\mu$m. Focusing below the orifice surface permits deeper conditioning. For example, focusing at a depth of about 15 $\mu$m is desirable.

Figure 5:
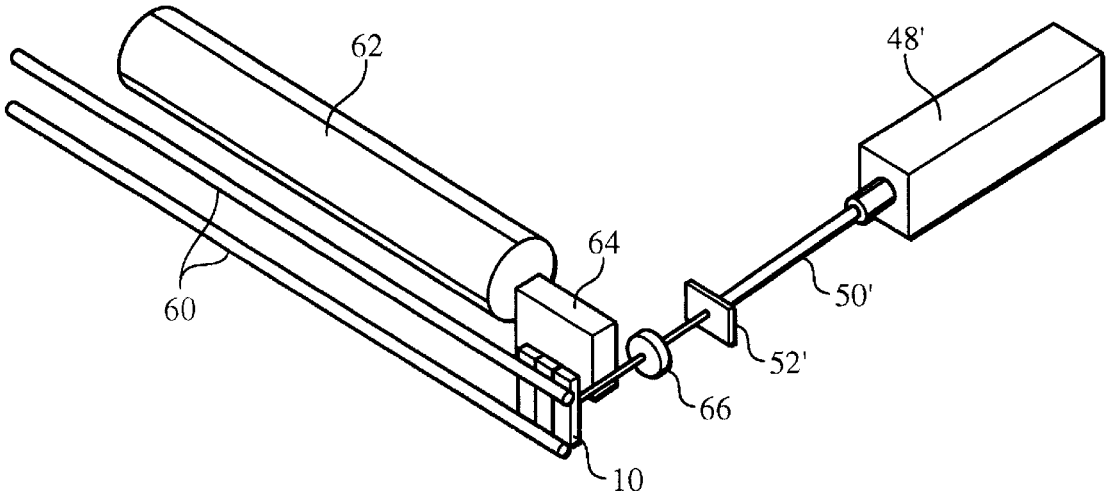
FIG. 5 is a schematic perspective view of another system for conditioning ink jet orifices.

Referring to FIG. 5, in an alternative embodiment, a conditioning system is integrated with a printing system so that the head can be readily conditioned immediately before, after, or even during an interruption of a printing operation. In this arrangement ink jet print heads 10 are mounted on rails 60, e.g., by a motor under computer control. The print heads 10 move along the rails 60 in response to signals transmitted along a flexible cable (not shown). The print heads 10 can be moved between three positions on the rails 60.

The print heads 10 may be positioned at a printing station, including a substrate holder 62, such as a roller, where it is used for printing, e.g., on paper (not shown). The print heads 10 may alternatively be positioned at jet function detection station 64 for testing the orifices 14. The print heads 10 may also be positioned at a conditioning station including a laser beam 50' for illuminating the orifices 14 of print head 10.

To test the orifices at the jet function detection station, print heads 10 print a test pattern on a piece of paper, e.g., with a grid. This test pattern is analyzed either visually by an operator with a loop or electronically. The test pattern can be electronically checked by an imaging system with a CCD and an x-y table. (Available from KDY, Inc., Nashua, N. H.)

If an orifice in need of conditioning is detected, the print head 10 is moved into the conditioning station. The laser beam 50' is directed at the defective orifice 14 by passing through a mask 52' and a lens 66 in the manner described in FIGS. 4A–C.

In other embodiments different radiation sources and/or power levels may be used. For example, an infrared source, e.g., a $CO_2$ laser operating at 10.6 $\mu$m or a copper vapor laser operating at 511 nm may be used. Excimer or frequency doubled Nd: YAG lasers use pulsed ultraviolet light to photochemically decompose, or ablate, material. Metals and organics are ablated at significantly different rates at ultraviolet wavelengths, so energy levels can be chosen to clean organic material while causing no damage to the surrounding metals. The penetration depth of the laser beam can also be controlled using a combination of number of pulses, etch rates and optics arrangements.

Table I provides the etch rates of various materials using a krypton fluoride excimer laser. This data was obtained for samples prepared by placing the contaminants on glass slides at 200° C. for 6 minutes to reflow and/or oxidize them.

TABLE I

| Sample | Wavelength | Etch Rates (microns/pulse) 0.375 Joules/cm$^2$ | 1.5 Joules/cm$^2$ | Comments |
|---|---|---|---|---|
| Tektronics Hot Melt Ink Jet Ink[1] | 248 nm | 1.27 | 1.87 | Clean Etch |
| Coates Hot Melting Ink Jet[2] | 248 nm | 1.60 | >3.60 | Some melting at higher fluence |
| Scorched Milk | 248 nm | 0.75 | 4.00 | Etch rates Dependent on Degree of Oxidation |
| Epon (R) 826 Epoxy[3] | 248 nm | 0.93 | 1.87 | Clean Etch |
| Trabond 2151 Epoxy[4] | 248 nm | 0.27 | 1.67 | $AL_2O_3$ filler Remains |
| Chocolate | 248 nm | 1.40 | 4.47 | |
| Caramelized Sugar | 248 nm | 1.20 | 3.20 | Clean Etching |
| Packaging Poly-ethylene | 248 nm | 0.27 | 0.73 | Slow Etching |
| Hot Melt Ink Varnish[5] | 248 nm | >0.53 | >0.53 | |

[1]Available from Tektronics, Inc., Beaverton, OR.
[2]Available from Coates, Inc., Hanover, NH.
[3]Available from Epon, Shell, Houston, TX.
[4]Available from Tra-Con, Bedford, MA.
[5]Hot melt ink varnish is highly oxidized ink residue scraped from an operating ink jet head.

Power densities in the desired operating ranges do not damage the orifice plate geometry. When irradiating solid nickel orifice plates, either as loose orifice plates or orifice plates epoxy bonded into array assemblies using the krypton fluoride laser, power densities below 0.1 Joules/cm$^2$ show no effect on the orifice plate; at 0.375 Joules/cm$^2$ slight hazing (oxidation discoloration) of the surface occurs; at 0.75 Joules/cm$^2$ the hazing goes away, but the surface texture appears smoother than originally; at 1.5 Joules/cm$^2$ the surface is etched and the lip of the orifice holes appear to round or reflow. An operating window of 0.19 to 0.75 Joules/cm$^2$ is preferable.

Inspection by SEM photos and optical microscopy both show little or no change to the orifice diameter or geometry.

An intermediate fluence (0.75 Joules/cm$^2$) appears to have a greater effect than at a higher fluence (1.5 Joules/cm$^2$). At the intermediate fluence, some rounding of the exit lip is visible in SEM photos. At the higher fluence, this does not appear. The higher fluence does show discoloration and texturizing both of which are similar to oxidation seen in plasma etching in air.

These effects are more visible on loose orifice plates than on assembled print heads. It is believed that this effect is thermal and that the bonded assembly dissipates heat from the orifice quickly. Slight bending, e.g., of unbonded orifice plates, at intermediate and higher fluences may indicate excessive thermal effects. If heating is excessive, an inert gas flow or other cooling arrangement can be used to cool the workpiece.

For polymer orifice plates, lower fluence is preferable. The preferred fluence for conditioning a Kapton polymer orifice plate with a laser wavelength of 248 nm is about 0.38 Joules/cm$^2$. At 0.5–0.75 Joules/cm$^2$, the Kapton shows some gross distortion.

A variety of optical arrangements may be used depending on the objective, e.g., whether the cleaning is needed on the orifice plate surface or is required further into an orifice or in the countersink or bellmouth.

Figure 6:
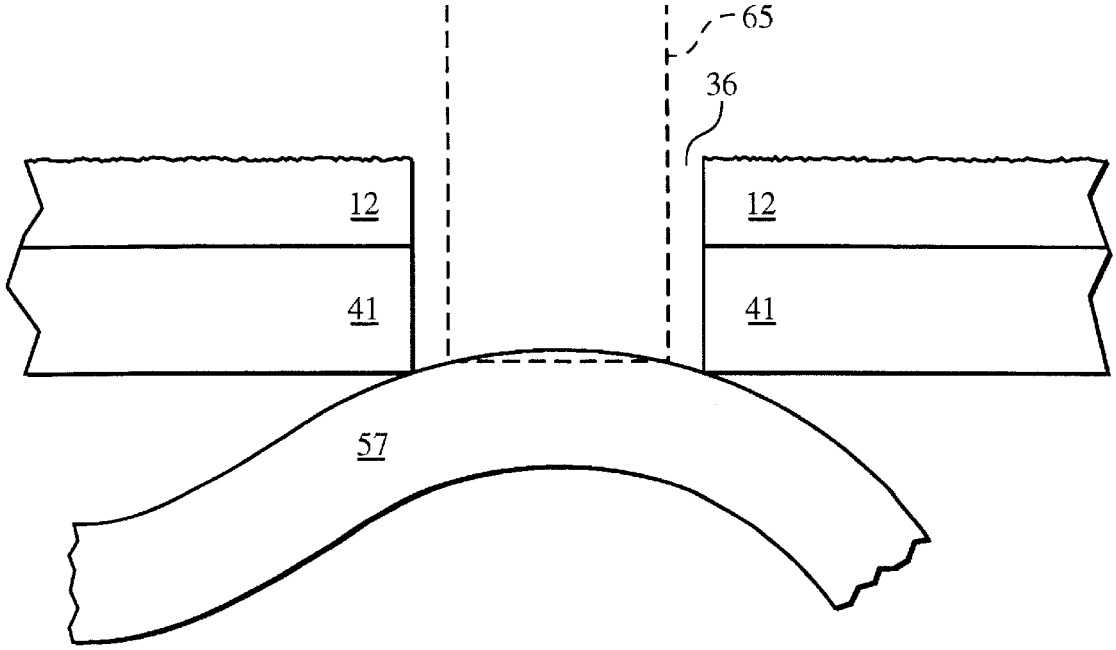
FIG. 6 is a cross section of an orifice contaminated with a fiber, during irradiation.

Referring to FIG. 6, a beam is sized smaller than the orifice opening to condition deep within, or even below the passageway. In this example, an orifice is contaminated by a fiber 57. The fiber 57 may be natural or synthetic; its source may be clothing. A laser beam 65, is focused or masked to a diameter smaller than the diameter of the orifice. In this way, a high beam density and/or long exposure time can be used to selectively ablate the fiber 57 without damaging the orifice plate 12. This technique may be particularly beneficial for conditioning polymer orifice plates, which can be made out of e.g., polyamide, and to avoid damage to backing plates made of e.g., the carbon.

Figure 7:
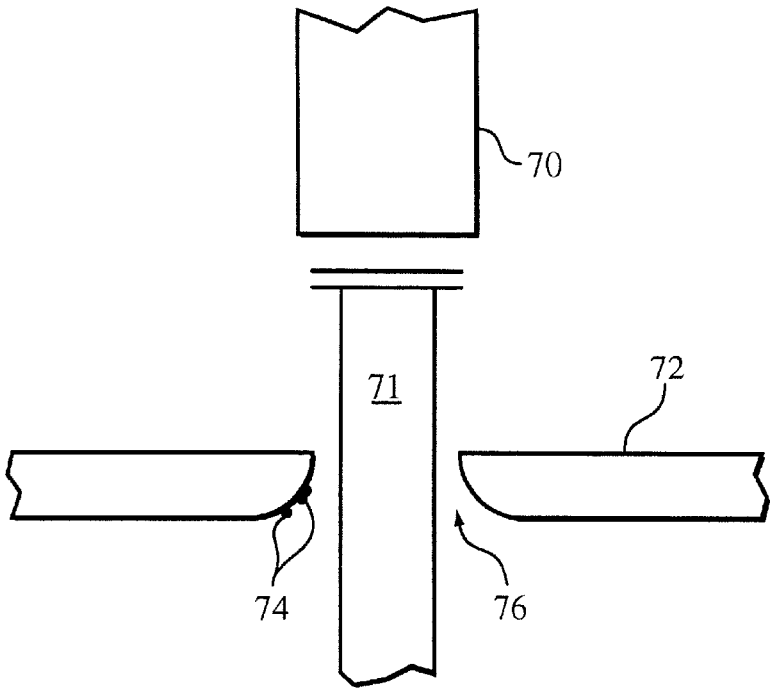
FIG. 7 is a schematic view of illumination of an orifice.
Figure 8:
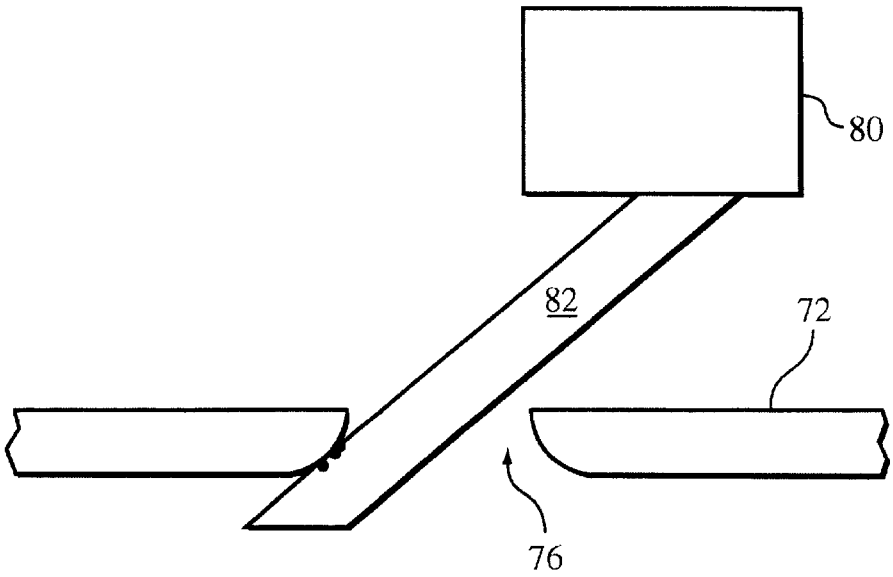
FIG. 8 is a schematic view of illumination of an orifice using a particular optical arrangement.

Referring to FIGS. 7 and 8, due to the geometry of some orifices, it may be difficult to illuminate certain areas in the orifice. In FIGS. 7 and 8, contaminants lodged in an area below the orifice opening known as the bellmouth may contribute to jet straightness and therefore may be conditioned. Referring particularly to FIG. 7, a laser 70 producing a collimated beam 71 directed on the axis of the orifice of a plate 72 may not irradiate the contamination 74 in a countersink or bellmouth region 76. Referring to FIG. 8, an optical system 80 may be used to direct a beam 82 at an angle so that the contamination is illuminated and removed from the bellmouth.

Figure 9:
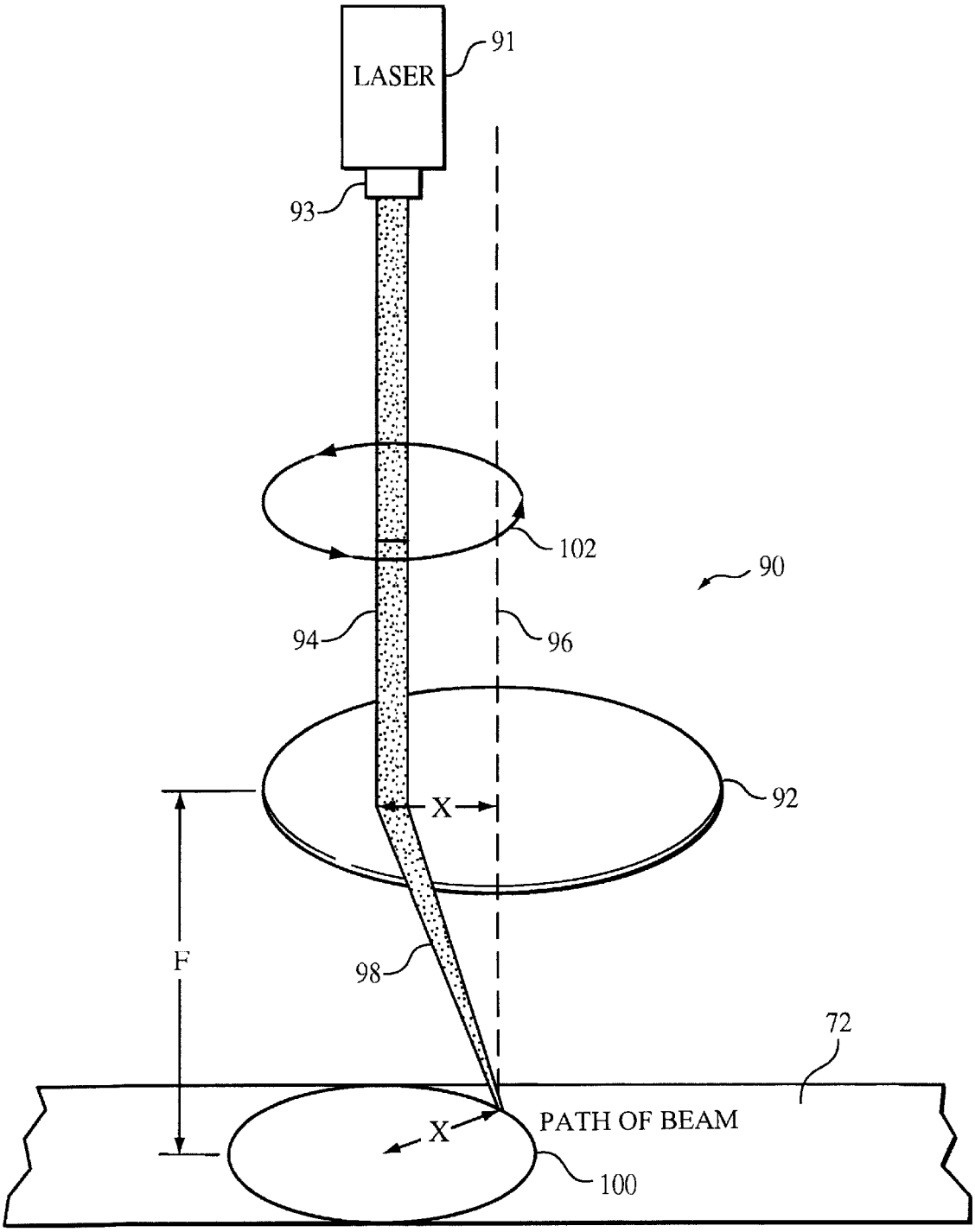
FIG. 9 is a schematic view of illuminating an orifice using another optical arrangement.

Referring to FIG. 9, an optical arrangement 90 is provided so that a beam may be scanned around the orifice to condition the bellmouth region about its entire circumference. The arrangement includes a laser 91, with a spatial filter and collimating lens 93 and a focusing lens 92. The focusing lens 92 is positioned to intercept a beam 94 at a location off the lens axis 96. The focused beam 98 is deflected at an angle into the orifice 100. To scan the beam 98, the lens is rotated as shown by arrows 102. The focal length of the lens typically must be small to achieve the proper scan radius and angle of the beam. For a 54 $\mu$m orifice (orifice opening radius x=27 $\mu$m) and an angle of 45° (tan=1), the focal, f, length is 27 $\mu$m. For a 37 $\mu$m orifice, the focal length is 18.5 $\mu$m. The focal length may be adjusted to compensate for the standard deviation of the orifices on a particular plate to provide consistent exposure on each orifice.

Figure 10:
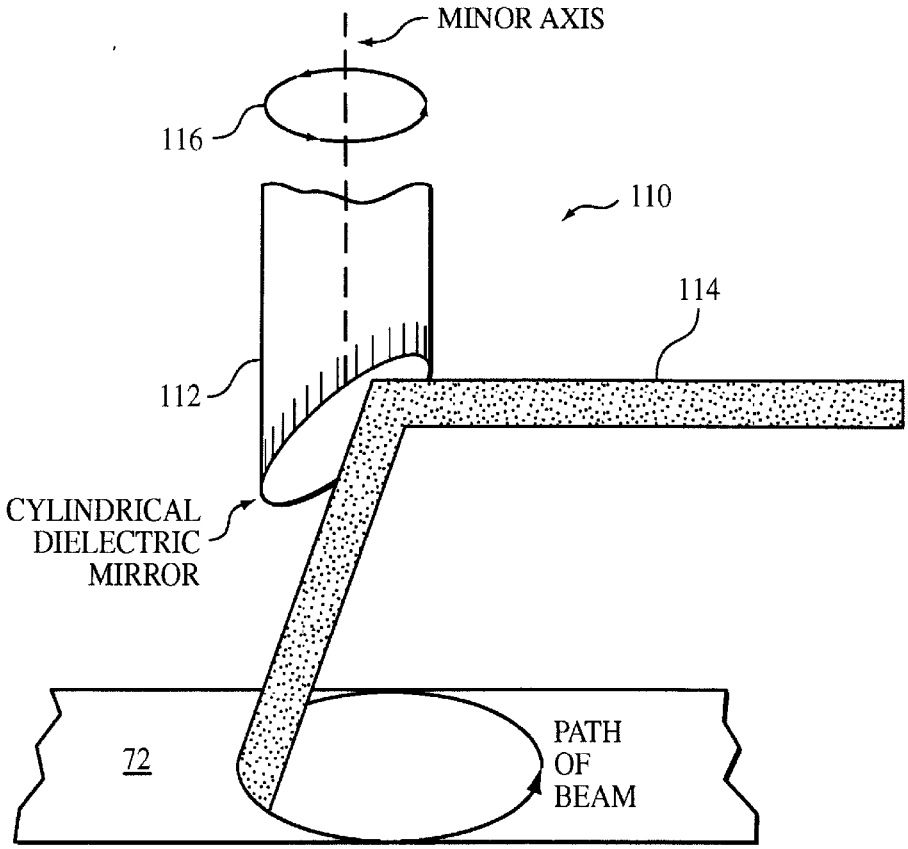
FIG. 10 is a schematic view of illuminating an orifice using another optical arrangement.

Referring to FIG. 10, in another arrangement 110, instead of using a lens to scan around the orifice, a cylindrical dielectric mirror 112 is used to deflect a beam 114. The beam is scanned by rotating the mirror 112 as indicated by arrows 116. Without an additional lens, this system lacks the ability to focus to a spot. But a very small beam diameter can be selected (e.g. by masking) before (or after) it is reflected at the mirror. Also, there is less attenuation with the dielectric mirror.

Figure 11:
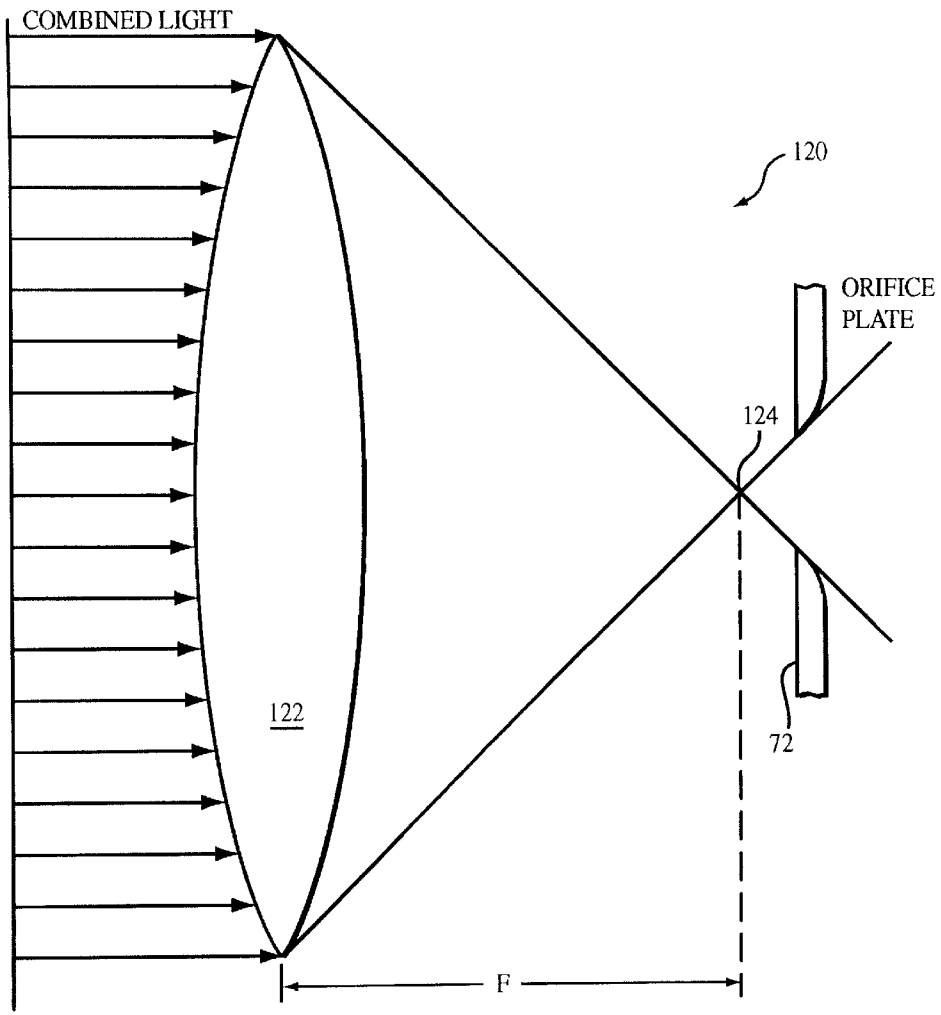
FIG. 11 is a schematic view of illuminating an orifice using another optical arrangement.

Referring to FIG. 11, a system 120 for cleaning beneath the outer surface of the orifice plate 72 is illustrated which uses a convex lens 122 that will focus at point 124. Beyond this focal point the light will diverge. With selection of the lens the correct angular divergence can be achieved that just fits the orifice. Different lenses for orifice plates of different diameter may be used or the distance, f, from the focal point to the orifice may be changed. This arrangement requires minimal alignment upon installing heads for cleaning. For single clogs and crookeds, a convex lens using incoming collimated UV laser light, with the print head orifice positioned outside the focal point to collect the diverging beam may be used. Since conditioning is substantially line of site, for conditioning beyond the edge of the orifice and into the print head, divergence of the beam beyond the orifice entrance is desirable.

Figure 12:
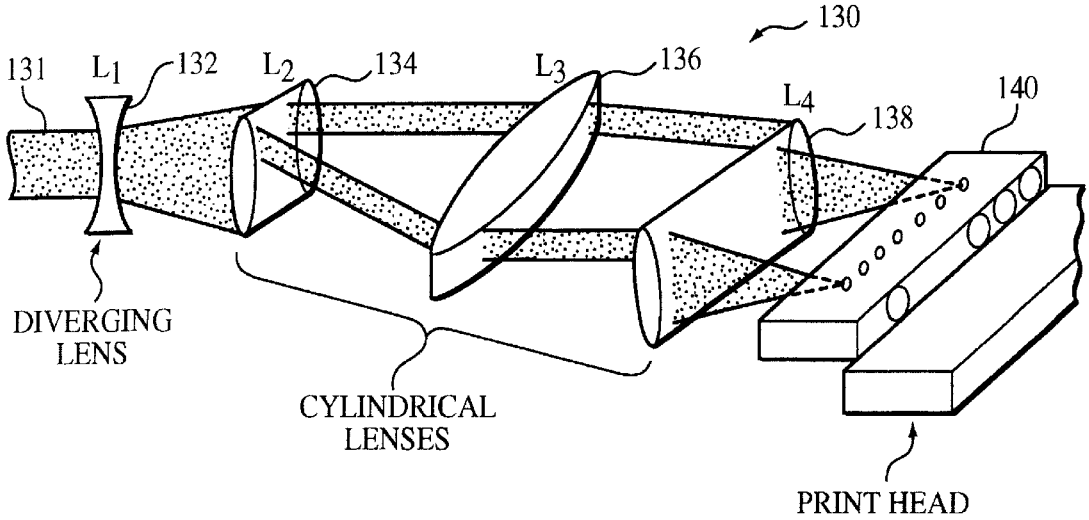
FIG. 12 is a schematic view of illuminating an orifice using another optical arrangement.

Referring to FIG. 12, a system 130 uses a diverging lens 132 and cylindrical lenses 134, 136, 138 to expand the beam 131 and expose all of (or a subset of) the orifices 141 of a print head 140 simultaneously. The system is illustrated arranged to illuminate the orifices of an oblique angle. Alternatively, the system can be arranged to illuminate the orifice plate along the axis of the orifices. This system can be used for pre-cleaning or surface cleaning, e.g., to clean heads after assembly and prior to the introduction of ink. This system could also be used in removing varnish from the outer surface of the orifice plate.

Combinations of the systems above can also be used. For example, the systems described in FIGS. 11 and 12 can be used in combination. The system in FIG. 12 could be used to clean the orifice plate surface first, followed by a deeper cleaning with the system in FIG. 11.

In further embodiments, particularly for conditioning well into the orifice plate, a laser assist gas, e.g., Krypton fluorine and/or an argon fluoride laser gas charge can be used to produce radiation at 168 nm. This wavelength of UV creates ozone which would assist in etching back isotropically into organics beyond the orifice opening. Further embodiments include conditioning the ink jet head to smooth surfaces proximate the orifices, even when no contamination is present. The orifices may also be conditioned without prior inspecting or testing. For example, conditioning may occur after a given number of printing operations, without first inspection or testing the orifices. The conditioning system can also be used to clean-off conformal coatings which are vapor deposited over the entire head assembly as part of the manufacturing process. For example, it is.desirable to eliminate parylene, an organic, vapor deposited film from the region right around the orifice, because it has the tendency to shred and make the jets crooked. Before introducing ink, the parylene is removed locally by laser radiation. This enables the benefits of conformal coating as described in Moynihan, U.S. Pat. No. 4,947,184, the entire contents of which is incorporated herein by reference, without the drawbacks of having a fragile film in the nozzle.

Further embodiments are within the following claims.

What is claimed is:

1. A method of conditioning an ink jet orifice by removing contaminant material, comprising:

providing an ink jet orifice, providing a radiation source comprising a laser, and illuminating said orifice with radiation to remove said contaminant material.

2. The method of claim 1 wherein the radiation is selected to remove organic contaminant material.

3. The method of claim 2 wherein the organic material is selected from the group consisting of ink, polymer, and protein.

4. The method of claim 1 wherein the radiation is selected to smooth regions of said ink jet head proximate the orifice.

5. The method of claim 1 wherein the radiation is provided by an excimer laser.

6. The method of claim 1 wherein said radiation is UV radiation.

7. The method of claim 5 wherein the excimer laser has a wavelength of about 248 nm and a fluence of about 0.3 to about 1.5 Joule/$cm^2$.

8. The method of claim 7 wherein the fluence is about 0.5 Joule/$cm^2$.

9. The method of claim 1 wherein the radiation is focused to a focal point.

10. The method of claim 9 wherein the radiation is selected to remove contamination to a depth inside the orifice no greater than about 15 $\mu$m.

11. The method of claim 10 wherein said focal point is inside the orifice.

12. The method of claim 1 wherein the orifice has a width and the radiation has a beam diameter smaller than the width of said orifice.

13. The method of claim 12 wherein the orifice defines an axis therethrough and the radiation impinges said orifice at an angle with respect to the axis of said orifice.

14. The method of claim 1 further comprising using a coolant in proximity with said orifice.

15. The method of claim 14 wherein said coolant is a gas.

16. The method of claim 1 comprising utilizing an ozone-forming gas and radiation at a wavelength selected to form ozone.

17. The method of claim 1 wherein the orifice is in a plate fabricated from metal, polymer, or ceramic.

18. The method of claim 17 wherein the orifice has a diameter of about 70 $\mu$m or less.

19. The method of claim 18 wherein the plate has a plurality of orifices separated by about 0.15 inch or less.

20. The method of claim 1 wherein said ink jet orifice is an ink jet orifice for a piezoelectric drop on demand ink jet head.

21. The method of claim 1 comprising:

testing the operation of said orifice.

22. The method of claim 21 comprising:

testing by jetting a test image.

23. The method of claim 22 comprising:

visually inspecting said image.

24. The method of claim 22 comprising:

electronically inspecting said image.

25. A system for conditioning an ink jet head including an ink jet orifice by removing contaminant material, comprising:

a printing station arranged to permit said print head to print an image on a substrate, and a radiation source comprising a laser arranged to illuminate said orifice to remove said contaminant material.

26. The system of claim 25 wherein the radiation is sufficient to remove organic contaminant material.

27. The system of claim 25 wherein the radiation is sufficient to smooth regions of said ink jet head proximate the orifice.

28. The system of claim 25 wherein the radiation source is an excimer laser.

29. The system of claim 25 further comprising:

a testing station arranged to test orifice performance.

30. The system of claim 25 or 29 comprising:

a transport arrangement to transport said orifice from the printing station to an illuminating station including said source of radiation.

31. The system of claim 30 wherein said transport arrangement transports said print head between said printing station, testing station, and conditioning station.

32. The method of claim 31 wherein said transport arrangement includes a rail system.

33. A system for conditioning including an ink jet orifice by removing contaminant material, comprising:

a testing station arranged to test orifice performance, and a radiation source comprising a laser arranged to illuminate said orifice to remove said contaminant material.

34. The system of claim 33 wherein the radiation is sufficient to remove organic contaminant material.

35. The system of claim 33 wherein the radiation is sufficient to smooth regions of said ink jet head proximate the orifice.

36. The system of claim 33 wherein the radiation source is an excimer laser.

37. The system of claim 33 comprising:

a transport arrangement to transport said orifice from the testing station to an illuminating station including said source of radiation.

38. A method of conditioning an ink jet orifice by smoothing regions of an ink jet head proximate the orifice, comprising:

providing an ink jet head comprising an ink jet orifice, providing a radiation source comprising a laser, and illuminating said orifice with radiation to smooth regions of said ink jet head.

* * * * *